US008534781B2

(12) United States Patent
Netzer et al.

(10) Patent No.: US 8,534,781 B2
(45) Date of Patent: Sep. 17, 2013

(54) EJECTION DEVICE FOR A MOVABLE FURNITURE PART

(75) Inventors: Emanuel Netzer, Höchst (AT); Andreas Holzer, Dornbirn (AT)

(73) Assignee: Julius Blum GmbH, Höchst (AT)

( * ) Notice: Subject to any disclaimer, the term of this patent is extended or adjusted under 35 U.S.C. 154(b) by 0 days.

(21) Appl. No.: 13/282,819

(22) Filed: Oct. 27, 2011

(65) Prior Publication Data

US 2012/0038255 A1 Feb. 16, 2012

Related U.S. Application Data

(63) Continuation of application No. PCT/AT2010/000111, filed on Apr. 16, 2010.

(30) Foreign Application Priority Data

May 13, 2009 (AT) ..... A 728/2009

(51) Int. Cl.
*A47B 95/00* (2006.01)
*A47B 95/02* (2006.01)
*A47B 88/00* (2006.01)

(52) U.S. Cl.
USPC ..... 312/331; 312/319.1

(58) Field of Classification Search
USPC ..... 312/319.1, 333, 331, 330.1, 402
See application file for complete search history.

(56) References Cited

U.S. PATENT DOCUMENTS 4,089,408 A * 5/1978 Vanderhoof ..... 198/890.1
4,265,502 A * 5/1981 Blodee et al. ..... 312/109
5,302,016 A * 4/1994 Lautenschlager et al. .... 312/333
6,352,006 B1 * 3/2002 Kurashita ..... 74/409
6,588,060 B1 * 7/2003 Arentsen et al. ..... 16/87 R
6,641,239 B2 * 11/2003 Kaiser ..... 312/404
6,698,258 B2 * 3/2004 Westwinkel ..... 70/85
7,430,937 B2 * 10/2008 Rotter et al. ..... 74/422

(Continued)

FOREIGN PATENT DOCUMENTS

AT 502 937 6/2007
AT 503 497 10/2007

(Continued)

OTHER PUBLICATIONS

Machine Translation of WO 2007/087656 A1.*

(Continued)

*Primary Examiner* — Janet M Wilkens
*Assistant Examiner* — Andrew Roersma
(74) *Attorney, Agent, or Firm* — Wenderoth, Lind & Ponack, L.L.P.

(57) ABSTRACT

The invention relates to an arrangement for locking and ejecting a movable furniture part, comprising two unlockable ejection devices arranged on both sides of a furniture body or on the movable furniture part, and spring-loaded ejectors, wherein the unlockable ejection devices comprise a catch element mounted on a linearly displaceable carriage, the catch element engaging into a slotted guide path having the shape of a heart curve and by which the movable furniture part can be held in a closed latching position (E) via a locking element. According to the invention, this latching position (E) can be released by overpressing the movable furniture part towards the interior, wherein the linearly displaceable carriages of the two unlockable ejector devices are motionally coupled via a rotatable synchronization rod.

23 Claims, 14 Drawing Sheets

(56) References Cited

U.S. PATENT DOCUMENTS

| | | | | |
|---|---|---|---|---|
| 2007/0046159 | A1* | 3/2007 | Hoffman | 312/333 |
| 2007/0103041 | A1* | 5/2007 | Kropf et al. | 312/333 |
| 2008/0036345 | A1* | 2/2008 | Kropf et al. | 312/333 |
| 2008/0054771 | A1* | 3/2008 | Brunnmayr | 312/323 |
| 2009/0072687 | A1 | 3/2009 | Fitz | |
| 2009/0284114 | A1 | 11/2009 | Fitz | |
| 2010/0219727 | A1* | 9/2010 | Aguilar Ante et al. | 312/319.1 |

FOREIGN PATENT DOCUMENTS

| | | | |
|---|---|---|---|
| DE | 20 2005 006 945 | | 6/2006 |
| EP | 1 183 963 | | 3/2002 |
| EP | 1 785 063 | | 5/2007 |
| EP | 1 887 172 | | 2/2008 |
| WO | WO 2006066774 | A1 * | 6/2006 |
| WO | 2006/113953 | | 11/2006 |
| WO | 2007/087656 | | 8/2007 |
| WO | 2007/112463 | | 10/2007 |
| WO | 2008/098266 | | 8/2008 |
| WO | 2009/114885 | | 9/2009 |
| WO | WO 2009119923 | A1 * | 10/2009 |

OTHER PUBLICATIONS

Machine Translation of WO 2006/066774 A1.*

International Search Report issued Aug. 24, 2010 in International (PCT) Application No. PCT/AT2010/000111.

Austrian Patent Office Search Report completed Feb. 25, 2010 in Austrian Patent Application No. A 728/2009.

* cited by examiner

EJECTION DEVICE FOR A MOVABLE FURNITURE PART

This application is a Continuation of International application No. PCT/AT2010/000111, filed Apr. 16, 2010, the entire disclosure of which is incorporated herein by reference.

BACKGROUND OF THE INVENTION (1) Field of the Invention

The invention concerns an arrangement for locking and ejecting a movable furniture part comprising two unlockable ejection devices arranged at both sides on a furniture body or on the movable furniture part, and spring-loaded ejectors, wherein the unlockable ejection devices have a latching element mounted on a linearly displaceable carriage, wherein the latching element engages into a heart curve-shaped sliding guide path, by way of which the movable furniture part can be held in a closed latching position with or by way of a locking element arranged on the carriage, and wherein the latching position can be released by overpressing the movable furniture part inwardly. The invention further concerns an unlockable ejection device for such an arrangement.

(2) State of the Prior Art

Devices have already been long been known in furniture fitment design which can lock movable furniture parts, in particular drawers, by way of a so-called touch-latch mechanism. In that case the furniture fitments are of such a design that when the drawer is closed unlocking of the drawer is effected by additionally pressing the drawer in (overpressing), whereby the drawer is ejected by a storage means which is loaded up in the closing movement (generally a spring).

If such an individual fitment is used on one side of a relatively wide drawer the overcoming point or release point of the touch-latch mechanism can differ depending on the respective distance of the point at which the drawer is touched. That often results in the movable furniture part adopting a skew position, which is undesirable.

In that respect for example EP 1 785 063 A1 has already proposed a solution, wherein there is provided a torsion rod which allows direct transmission of movement of a pivotable locking mechanism from one side of the drawer to the other side. A similar configuration is known from EP 1 887 172 A2. AT 502 937 A1 also concerns an actuating device arranged at each of two sides on an article of furniture for moving movable furniture parts (a flap), wherein the two actuating devices for synchronous movement thereof are motionally coupled together by a synchronization rod.

A disadvantage with those structures is that those furniture fittings require a very great deal of space as they are arranged behind the drawer, whereby the drawer cannot extend completely to the end of the furniture body. In addition the separate implementation of the locking and ejection devices means that an increased amount of space is required whereby only the locking elements are motionally coupled directly by way of the synchronization rod. In EP 1 785 063 A1 the actual ejector is arranged in the region of the extension guide assembly (see reference 23), whereby that ejection movement cannot be synchronized by way of the torsion rod. As a result the entire movable furniture part also assumes skew positions upon ejection as unlocking is admittedly effected substantially simultaneously by the direct transmission of movement with the torsion rod, but the ejection forces can occur differently and independently of each other on both sides (slightly delayed unlocking, differing ejection force in the energy storage means, a skew position of the drawer already occurring upon triggering), whereby that involves non-uniform ejection on the two sides and the drawer is in a skew position during ejection or begins to assume a skew position and in the worst-case scenario can even become wedged in the furniture body.

A particular disadvantage in the state of the art is that the ejection travel distance is very long by virtue of the heart curve being present only at one side, particularly if the drawer is to be opened by overpressing on the diagonally opposite side. More specifically, in that case the overpressing force first has to be passed along the drawer to the end to the contact element. From there the torsion rod is caused to rotate, in which case twisting can occur when the drawer is a wide drawer. It is only then that the movement is passed to the locking element with the heart curve, wherein after overpressing unlocking occurs and, after the movement is returned, both locking elements are unlocked and the drawer can be ejected.

It is further known from the state of the art to provide two unlockable ejection devices which are not synchronized, whereby, when the drawer is in an inclined position, unlocking at only one side can occur, particularly in the case of wide drawers, and that can lead to a problem. For example AT 503 497 A1 relates to a device for locking and ejecting movable furniture parts with spring-loaded ejectors (springs, ejection element) and a latching element (locking element), which engages into a heart curve-shaped sliding guide path on a housing and can be released by pressing inwardly (using the touch-latch principle). The arrangement includes a pull-in device. There is no provision for motional coupling by way of a rotatable synchronization rod.

SUMMARY OF THE INVENTION

Now the object of the present invention is to provide an unlockable ejection device which is improved in relation to the state of the art, and an arrangement having two synchronizable ejection devices. In particular the invention seeks to prevent inclined positioning of drawers in the latching position. The invention further seeks to ensure that the drawer opening movement is unlocked and triggered reliably and as much as possible at the same time, irrespective of the region in which a pressing force is applied to the movable furniture part.

That object is attained in that the linearly displaceable carriages of two unlockable ejection devices are motionally coupled by way of a rotatable synchronization rod. The linear displacement movement of the carriage is converted into a rotary movement of the synchronization rod. The heart curve at both sides also ensures that, at any location on the front of the drawer, the inward pressing force is registered and transmitted in a uniform fashion, thus providing for optimum triggering of the movement. This means that there is no fear of the movable furniture part adopting an inclined position upon triggering and also upon closing or upon being moved into the latching position.

In a preferred embodiment it can be provided that the carriage is connected to the synchronization rod by way of a transmission for movement conversion of the linear movement of the carriage into a rotary movement of the synchronization rod.

Particularly preferable is that the transmission include a displaceably mounted element at the ejection device side and a rotary element for force transmission at the synchronization rod side, the displaceably mounted element being motionally coupled to the carriage. This provides for direct transmission of force from the latching element to the displaceably mounted element.

In a preferred further embodiment it can be provided that the displaceably mounted element is a rack and the rotary element is a gear. Alternatively for example the transmission could be in the form of a belt drive or a friction wheel. As a further alternative a joint mechanism could also provide for movement conversion.

It can further preferably be provided that mounted on the carriage is a preferably pivotable locking element which, in a latching position of a latching element, holds the movable furniture part by way of a holding element arranged thereon in a locked position in a closed end position. In that way actual locking of the drawer takes place in the region of a locking element, wherein that locking element engages, by way of the guide carriage, the latching element and by way of a heart curve projection arranged thereon into the heart curve-shaped sliding guide path and holds it in the closed end position in the recess portion of the heart curve.

It can further preferably be provided that the movable furniture part can be opened or ejected by way of the holding elements arranged thereon by the ejector which is part of the unlockable ejection devices.

It can further be provided that the displaceable guide carriage is acted upon by an elastic element, preferably a spring.

To provide synchronization of the ejector and the locking element in an individual unlockable ejection device, a preferred embodiment of the invention can provide that the locking element, the rack, the ejector and the latching element are motionally coupled to the guide carriage.

To achieve a direct flow of force and thus synchronization of the ejection movement and the unlocking movement, that is as ideal as possible, it can be provided that the guide carriage, the ejector and the rack are in one piece.

Unlocking of the locking element can be ensured by the pivotability thereof, wherein it can particularly preferably be provided that both the locking element and also the latching element are mounted pivotably by way of a rotary or pivot point on the guide carriage.

For conveniently and reliably fitting an individual unlockable ejection device it can be provided that the guide carriage is arranged linearly displaceably in a housing, wherein preferably the rack, the ejector and the locking element project out of the housing through housing openings, whereby they can be brought into movement-transmitting contact on the one hand with the rotary element or the gear and on the other hand with the holding element of the drawer.

It is preferably further provided in that respect that in the housing is a heart curve-shaped sliding guide path into which engages a heart curve projection arranged on the latching element. In addition a control cam sliding guide path can be provided in the housing, wherein a control cam projection arranged on the locking element engages into that sliding guide path.

For simple and reliable mounting to the furniture body bottom or to the movable furniture part (in which case then the holding element is disposed on the furniture body), it can preferably be provided that the housing can be fitted on a mounting plate.

The simplest and most effective way of mounting the unlockable ejection device according to the invention or an overall arrangement of two unlockable ejection devices and a synchronization rod is achieved if the first and second unlockable ejection devices can be fitted without a tool by way of the mounting plates to spaced sides or surfaces of a furniture body of an article of furniture and can be connected by a subsequently inserted synchronization rod.

When the spring force of the ejector is loaded up and unloaded, it can further preferably be provided that the spring force of the spring acting on the guide carriage acts in the ejection direction of the movable furniture part and is loaded up in the closing movement of the movable furniture part, wherein upon the opening movement in the ejection direction the ejector linearly ejects the holding element of the movable furniture part by the motional coupling to the spring-loaded carriage.

In a further preferred embodiment it can be provided that at both ends the synchronization rod has the preferably rotationally secured gears, wherein the gears respectively mesh with the rack of the first and second ejection devices.

To ensure non-rotation ability, it can be provided that the gears are non-rotatably connected to the synchronization rod by way of splined shafts.

For simple mounting of the synchronization rod between the unlockable ejection devices which are possibly already mounted in place, It can preferably be provided that arranged in the synchronization rod is at least one elastic element, preferably a spring, which acts on at least one of the gears in the longitudinal direction of the synchronization rod. As an alternative thereto it can also be provided that arranged in the synchronization rod are two elastic elements which act in the longitudinal direction of the synchronization rod on the gears arranged in non-rotational relationship at the ends of the synchronization rod.

An individual unlockable ejection device has in particular a displaceable carriage motionally coupled to a transmission portion, and can be brought into force-transmitting or movement-transmitting relationship with a rotary element of a synchronization rod.

The invention is further directed to an article of furniture in which the arrangement can be referred to as a furniture fitment set, which includes two unlockable ejection devices according to the invention and a synchronization rod connecting them. The invention is further directed to an article of furniture having an unlockable ejection device.

BRIEF DESCRIPTION OF THE DRAWINGS

Further details and advantages of the present invention are described more fully hereinafter by means of the specific description with reference to the embodiments by way of example illustrated in the drawings in which.

DETAILED DESCRIPTION OF THE PREFERRED EMBODIMENTS

Figure 1:
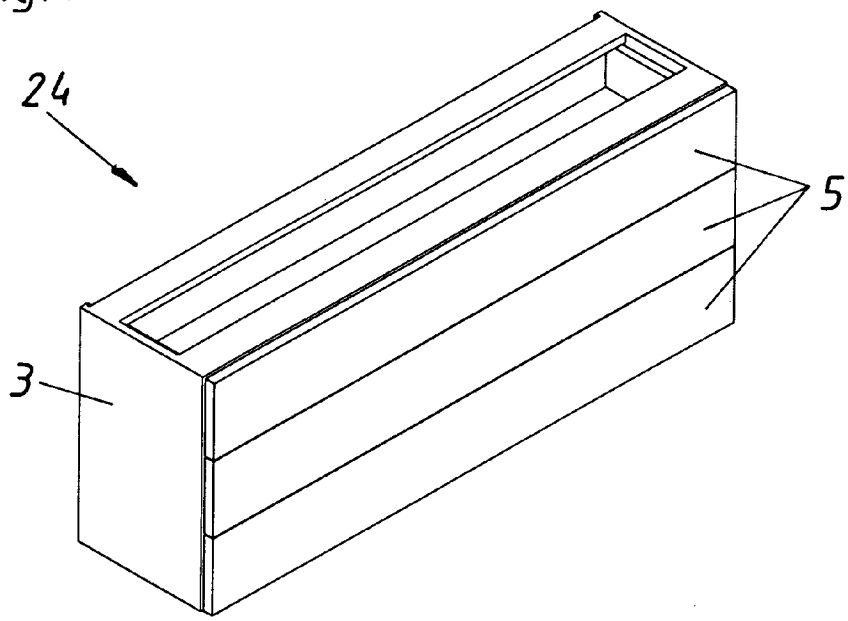
FIG. 1 shows a perspective view of an article of furniture.
Figure 2:
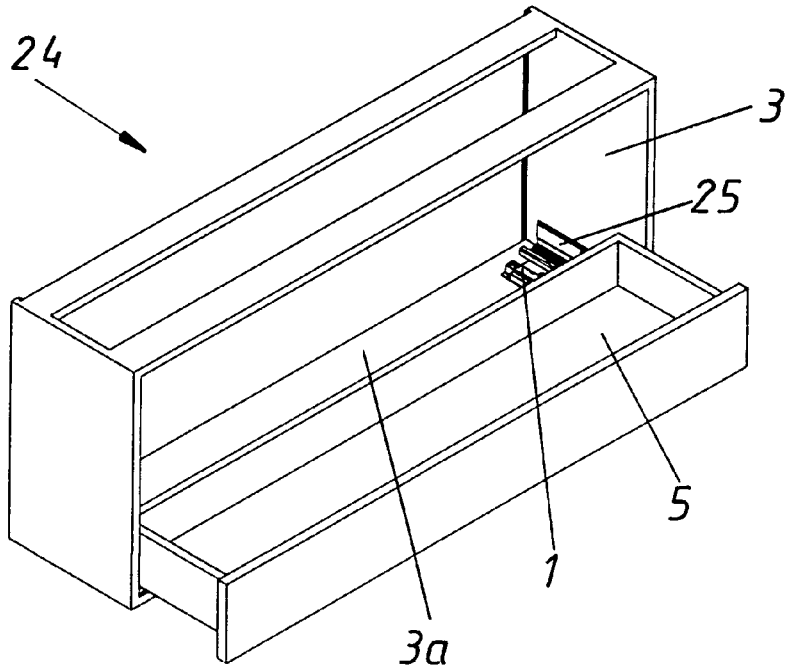
FIG. 2 shows a perspective view of an article of furniture with opened drawer.
Figure 3:
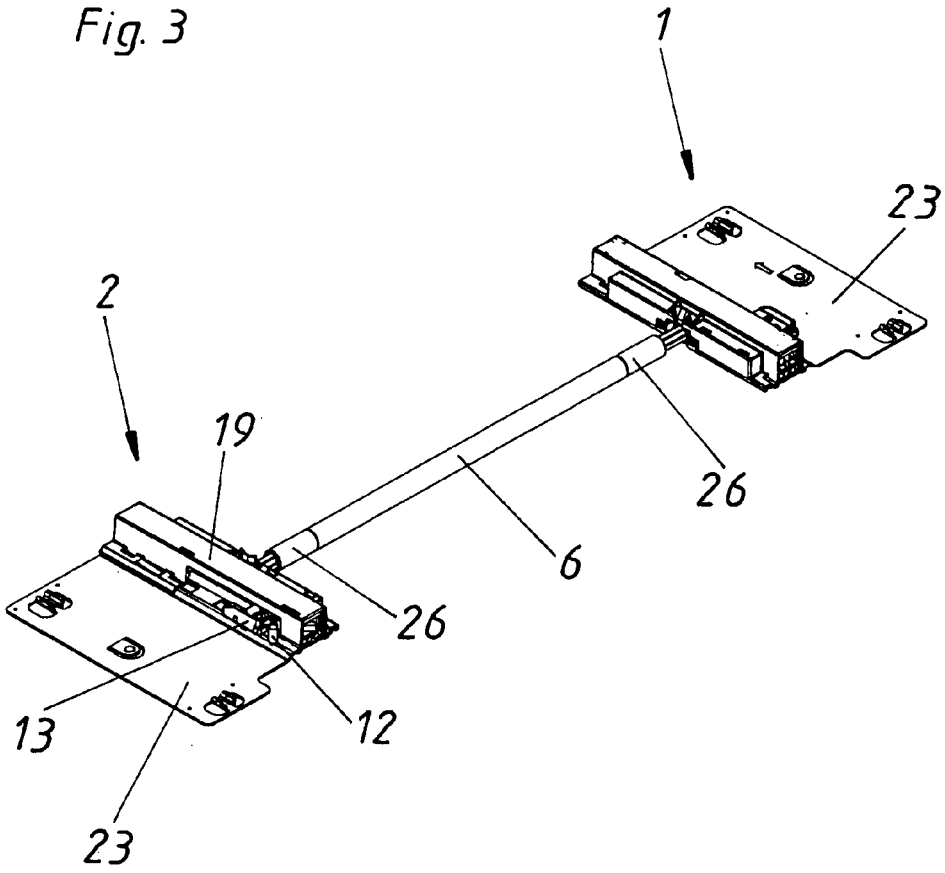
FIG. 3 shows a perspective view of a furniture fitment set.

FIG. 1 shows a perspective view of an article of furniture 24, three relatively wide movable furniture parts 5 being arranged in the furniture body 3. In FIG. 2 a movable furniture part 5 is extended from the body 3 of the article of furniture 24, or opened, thereby enabling a view onto extension guide means 25 and an unlockable ejection device 1 arranged at the furniture body bottom 3*a*. An unlockable ejection device 2 which is of substantially mirror-image symmetry relative to the unlockable ejection device 1 is arranged in the left-hand region, but is not visible from this perspective. As seen for example from FIG. 3, the two unlockable ejection devices 1 and 2 are connected by way of a synchronization rod 6. A housing 19 of the unlockable ejection devices 1 and 2 is fixed in this case on mounting plates 23 which in turn can be mounted on the body bottom 3*a* or on the movable furniture part 5. The left-hand region shows how an ejector 13 contacts a holding element 12 (connected to the movable furniture part 5 which is not shown here).

Figure 4:
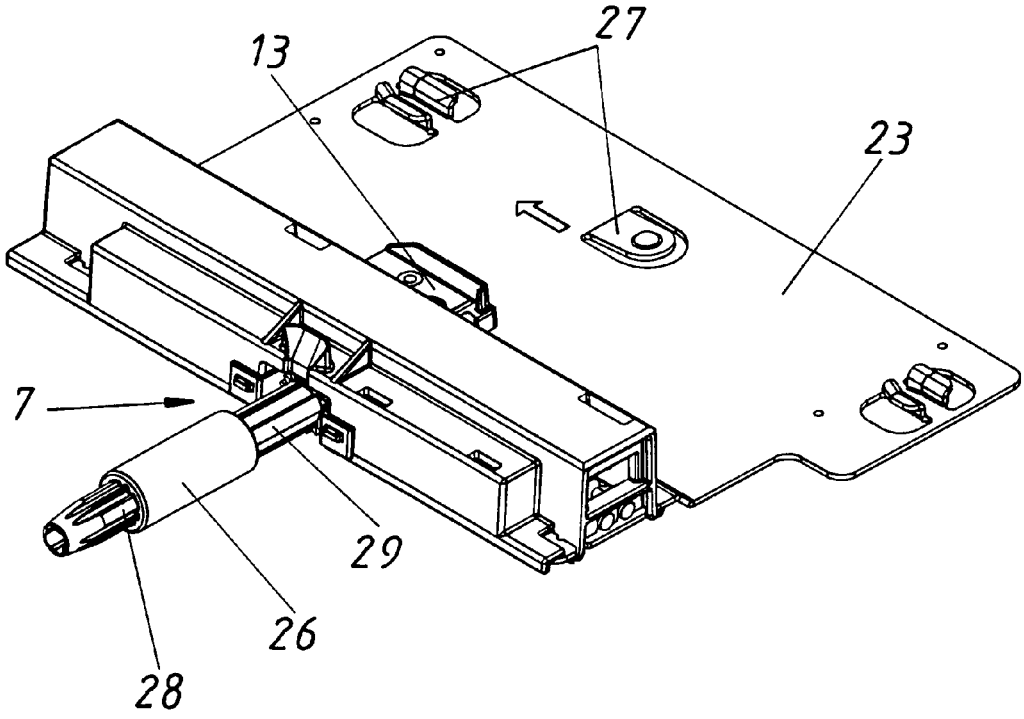
FIG. 4 shows a perspective view of an unlockable ejection device.

FIG. 4 shows fixing elements 27 of the mounting plate 23. The part of the synchronization rod 6 which is no longer shown in FIG. 4 is connected in force-transmitting relationship to a transmission 7 by way of a splined shaft 28 of a push-on element 26 and further by way of a splined shaft 29 which can be inserted therein. The synchronization rod in this case can be for example cylindrical of a round or oval cross-section and can be made for example from metal or plastic.

Figure 5:
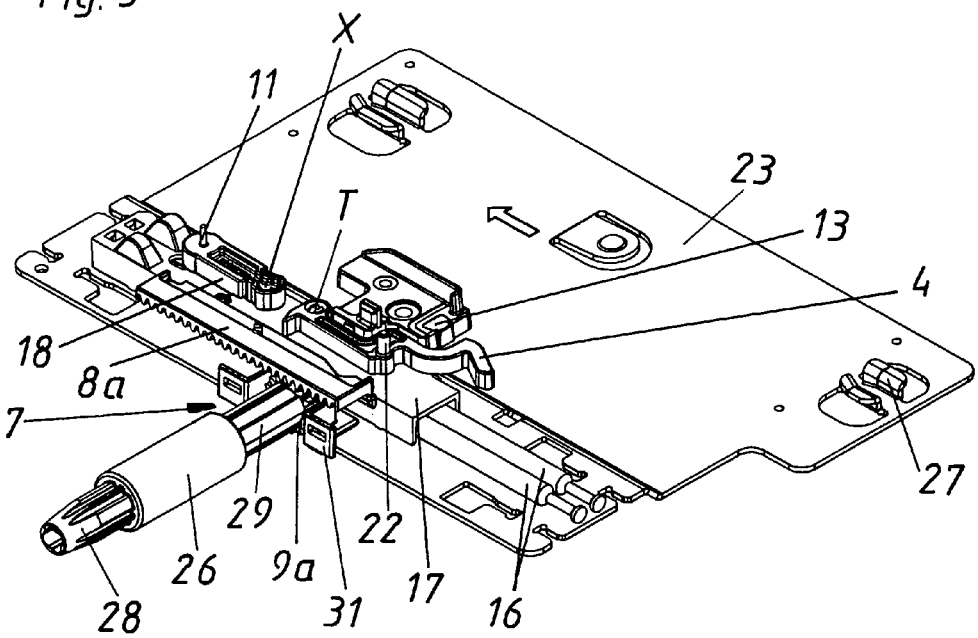
FIG. 5 shows a perspective view of an unlockable ejection device without housing.

FIG. 5 shows in greater detail how the transmission 7 is formed by a gear 9*a*, a rack 8*a* and a holding sleeve 31 for rotatably holding the gear 9*a*. The Figure further shows the interior of the housing 19 of the unlockable ejection device 1, wherein a guide carriage 17 is movable with a translatory movement in the longitudinal direction of elastic elements 16 (springs) in the housing 19. The ejector 13 and the rack 8*a* are made in one piece with the guide carriage 17. In addition a locking element 4 and a latching element 18 are arranged pivotably on the guide carriage 17. In this case the locking element 4 is mounted pivotably at a pivot point T and is guided pivotably by way of a control cam projection 22 in the control cam sliding guide path 21 (not shown here) upon a translatory movement of the guide carriage 17. That applies in a comparable manner to the latching element 18, which is connected at a pivot point X to the guide carriage 17 and which is guided pivotably at the underside of the housing 19 by way of a heart curve projection 11 in a heart curve-shaped sliding guide path 10 (not shown here).

Figure 6:
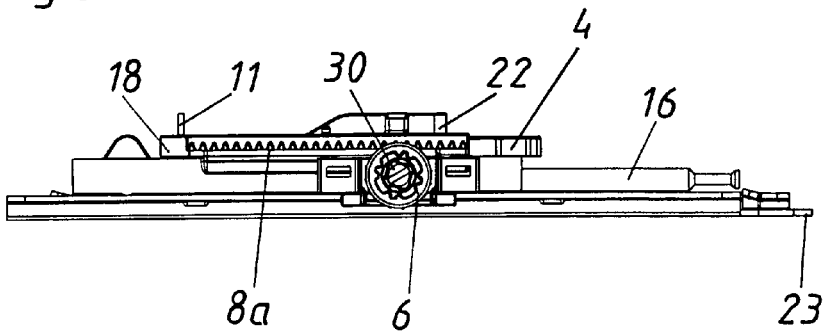
FIG. 6 shows a side view of the unlockable ejection device of FIG. 5.

FIG. 6 shows a side view of the unlockable ejection device 1 together with the synchronization rod 6 from FIG. 5. In this case the synchronization rod 6 has in its internal region splined shaft-shaped recesses and notches, into which the splined shaft 28 of the push-on element 26 engages in non-rotatable relationship therewith.

Figure 7:
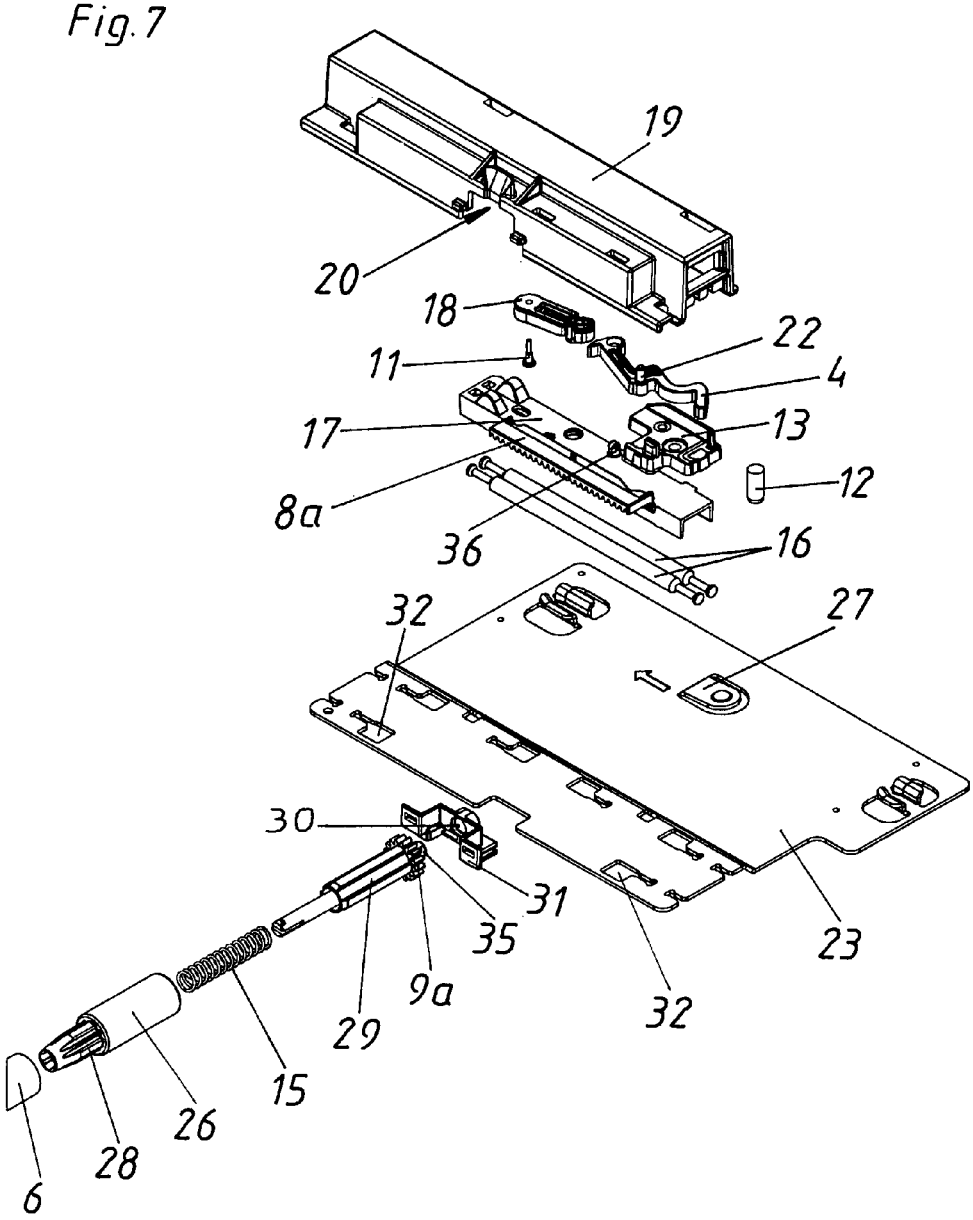
FIG. 7 shows an exploded view of the unlockable ejection device and a synchronization rod.

FIG. 7 shows the housing 19 together with a part of a housing opening 20 through which the rack 8*a* projects and can be brought into contact with the gear 9*a*. It can further be seen that the guide carriage 17, the rack 8*a* and the ejector 13 are in one piece. The heart curve projection 11 can be fitted into the latching element 18. The locking element 4 is in one piece with the control cam projection 22 and can be clipped on a pivotal projection 36. The Figure also shows a holding element 12 which is mounted to the movable furniture part 5 (not shown) and can be brought into contact with the ejector 13 and with the locking element 4. The elastic elements 16 act on the guide carriage 17 and are at least partially disposed between the guide carriage 17 and the mounting plate 23. The housing 19 can be fixed to the mounting plate 23 by way of fixing regions 32. The holding sleeve 31 together with a rotary bearing 30 for the gear 9*a* can also be fixed in the region of the housing opening 20, wherein the gear 9*a* is guided in the rotary bearing 30 by way of a rotary hub 35. The gear 9*a* can be non-rotatably mounted in the push-on connection 26 by way of the splined shaft-shaped portion 29 together with a spring holder extension 37, an elastic element 15 in the form of a spring being arranged therebetween. This affords a variation in length of the overall synchronization rod 6 and facilitates fitting the extension rod 6 between the unlockable ejection devices 1 and 2, which are not always arranged at the same spacing. In addition, the design configuration of the push-on connection 26 with elastic element 15 and splined shafts 29 together with the gear 9*a* means that commercially available metal cylindrical rods have to be only roughly cut to length, as the elastic element 15 provides that the overall synchronization rod 6 can be finely adjusted and inserted between the ejection devices 1 and 2.

Figure 8:
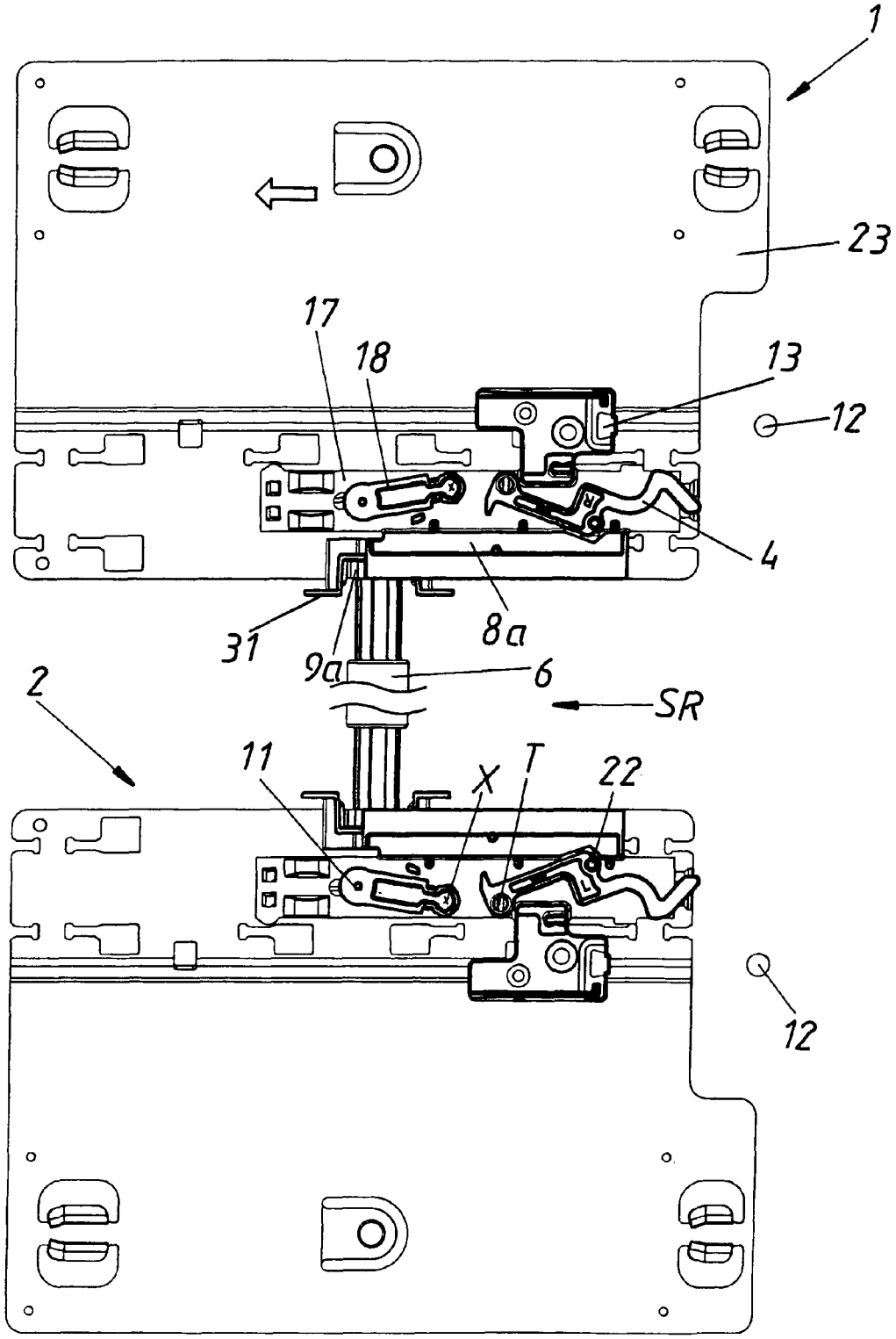
FIGS. 8 through 11 show plan views of two unlockable ejection devices together with the synchronization rod during the closure process.

FIG. 8 shows a plan view of the two unlockable ejection devices 1 and 2 connected by way of the synchronization rod 6. This Figure shows the position of the latching element 18, the guide carriage 17 with ejector 13 and the rack 8*a* and the locking element 4 when the movable furniture part 5 is open. Of that movable furniture part 5, FIG. 8 shows only the holding elements 12, the latter being moved in the closing direction SR.

Figure 9:
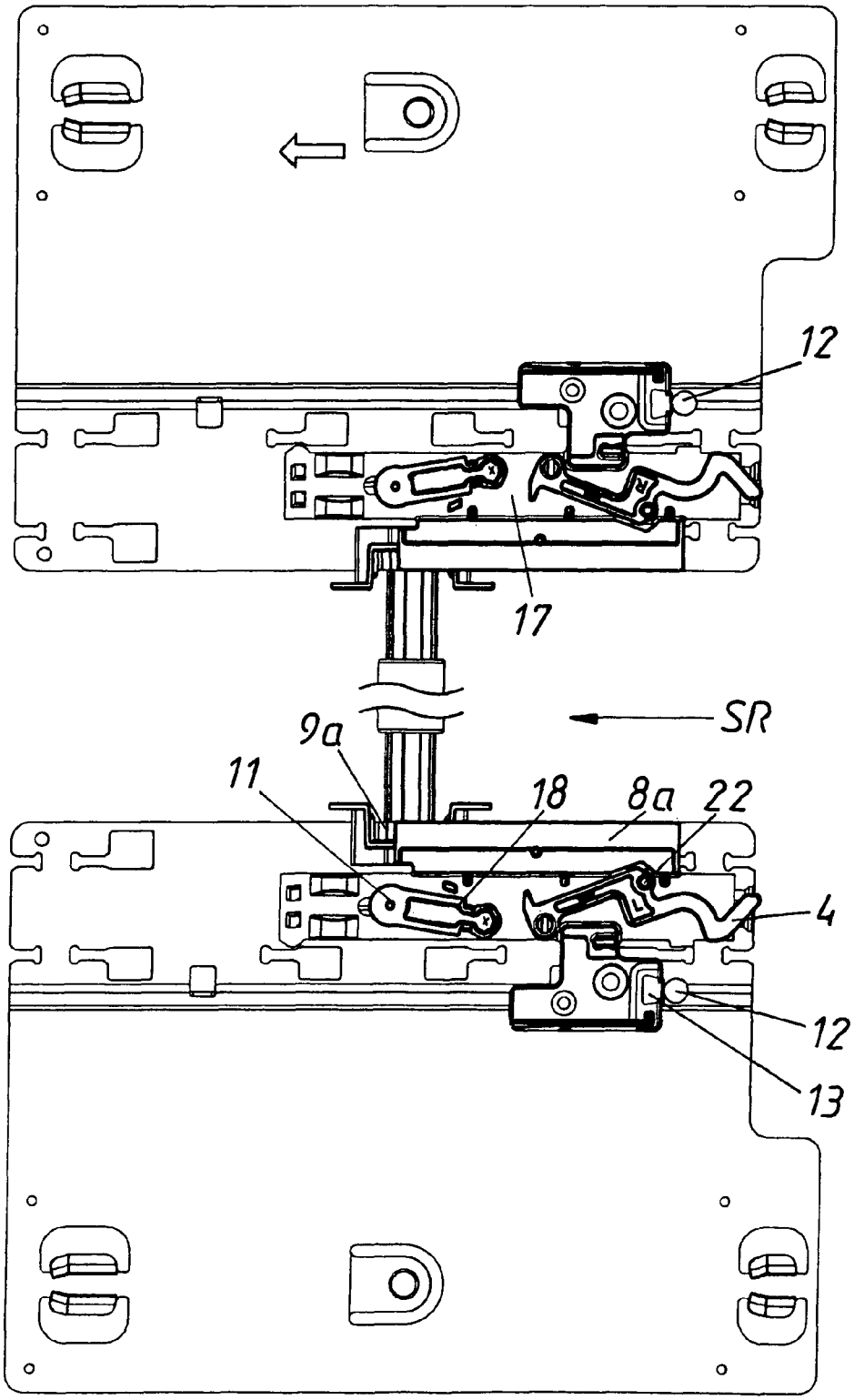

In FIG. 9 those holding elements 12 have moved so far in the closing direction SR that they contact the ejector 13 at the ejector fitment.

Figure 10:
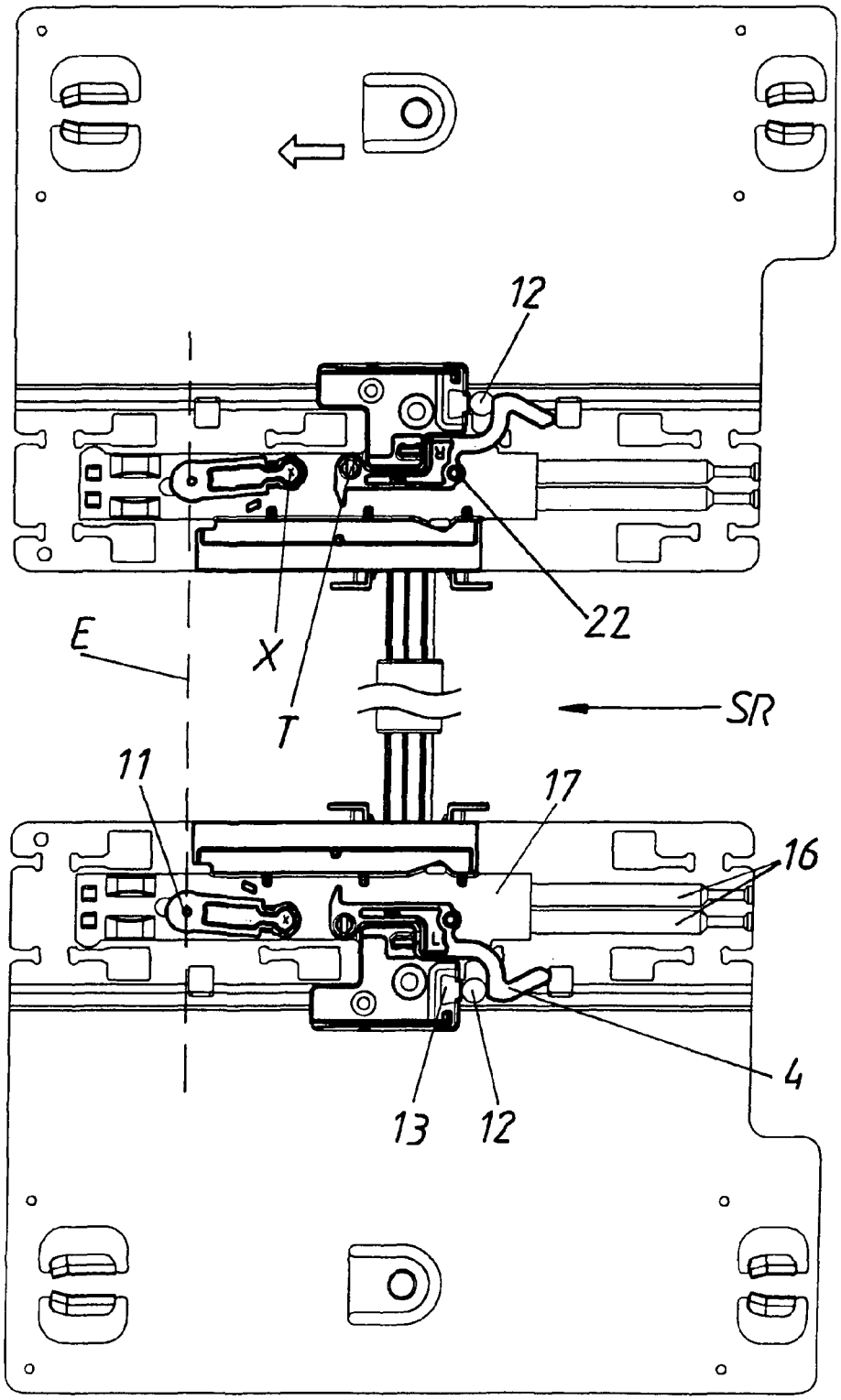

A further movement of the movable furniture part 5 in the closing direction SR means that the entire guide carriage 17 is moved in the closing direction SR by way of the ejector 13 and the holding element 12, until the movable furniture part 5 has reached the closed end position E (FIG. 10). During that closing movement SR the elastic elements 16 are stretched, whereby so-to-speak an energy storage means is loaded up. The heart curve projection 11 is held in a recessed region 33 of the heart curve-shaped sliding guide path 10 shown in FIG. 15, in that closed end position E.

Figure 11:
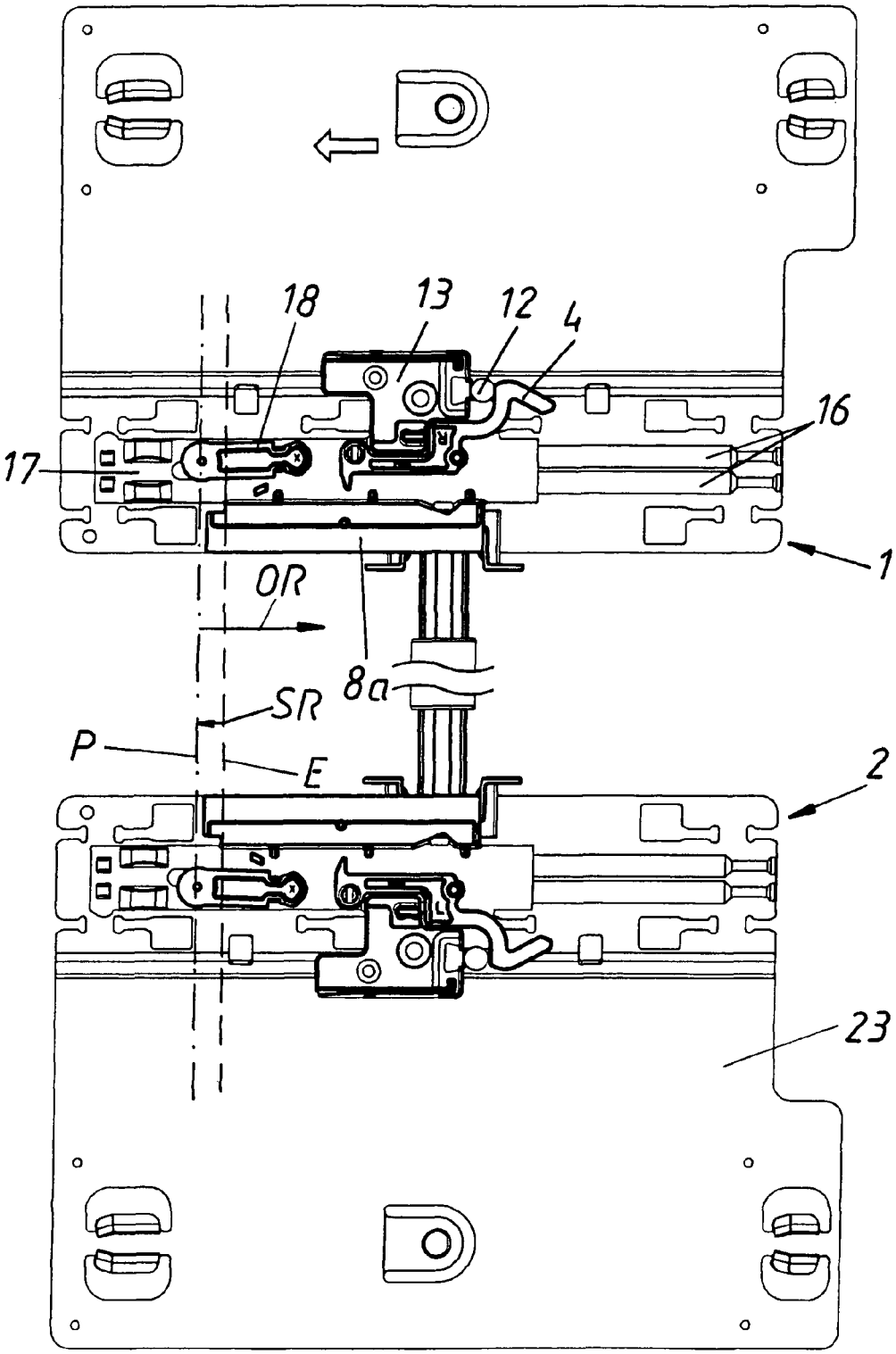

If now the heart curve projection 11 is further moved from the closed end position E in the closing direction SR (FIGS. 11 and 15), the curvature portion 34 of the heart curve is reached and then overcome (overcoming point), whereby the heart curve projection 11 passes into a position P behind the closed end position E, whereupon the heart curve projection 11 no longer prestresses the elastic element 16 by way of the latching element 18 and the guide carriage 17 and the element 16 can be unloaded and moves the guide carriage 17 together with ejector 13 in the opening direction OR. In that case the ejector 13 entrains the holding element 12 and thus the drawer 5 in the opening direction OR. In the opening movement OR the locking element 4 pivots away from the holding element 12 by virtue of the control cam projection 22 which is guided in the control cam sliding guide path 21, whereby the drawer 5 is unlocked and at the same time the ejection process can be implemented by the ejector 13 as the locking element 4 and the ejector 13 are motionally coupled by way of the guide carriage 17.

As all movements of the locking element 4, the ejector 13, the latching element 18 and the rack 8*a* are motionally coupled to the guide carriage 17 in the translatory direction at least in the region of the pivot points X and T, a transmission of movement is also effected by means of the transmission 7 to the rotary movement of the synchronization rod 6 and thereby to the respective other unlockable ejection device 1 or 2 respectively.

Figure 12:
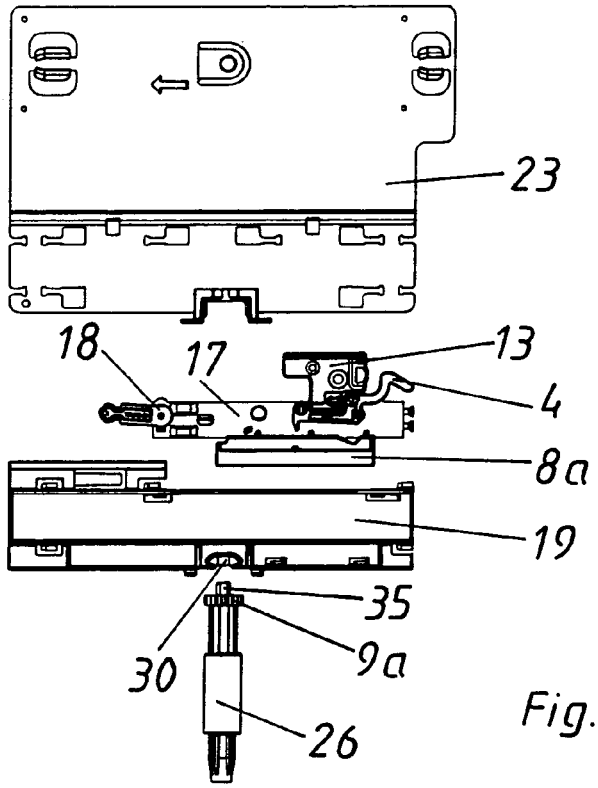
FIG. 12 shows an exploded plan view of the unlockable ejection device.
Figure 13:
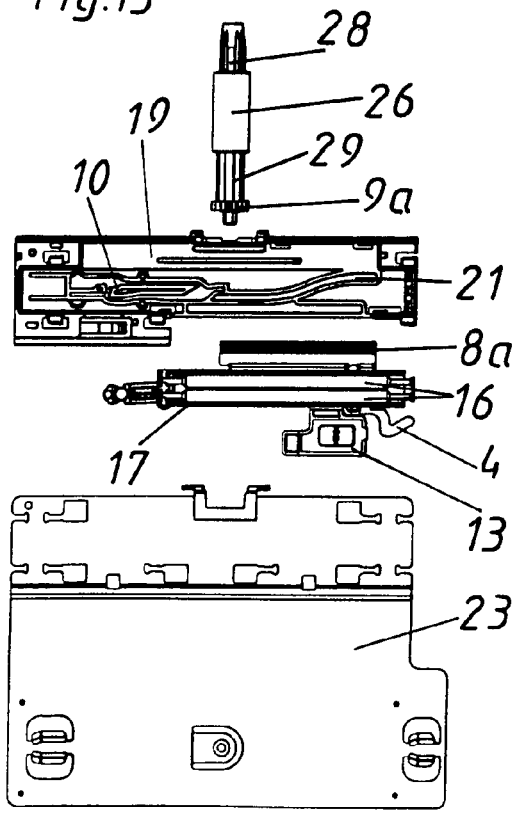
FIG. 13 shows a view from below of an unlockable ejection device in the exploded condition.
Figure 14:
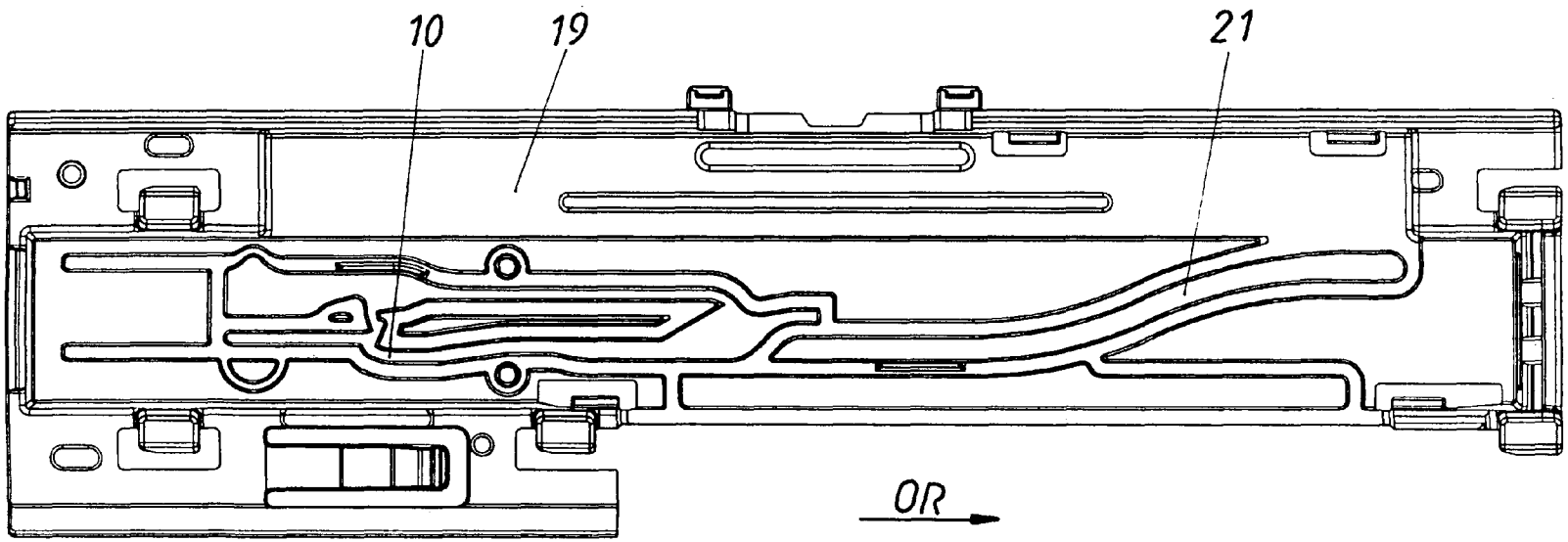
FIG. 14 shows the housing from below.

FIG. 12 shows a plan view of the essential parts of the unlockable ejection device 1 while FIG. 13 shows a corresponding view from below. In that respect FIG. 13 shows how the elastic elements 16 are arranged beneath or within the guide carriage 17 and are connected thereto in positively locking relationship in the left-hand region. Also shown on the underside of the housing 19 are the heart curve-shaped sliding guide path 10 and the control cam sliding guide path 21, the latter being also shown in FIG. 14 in greater detail.

Figure 15:
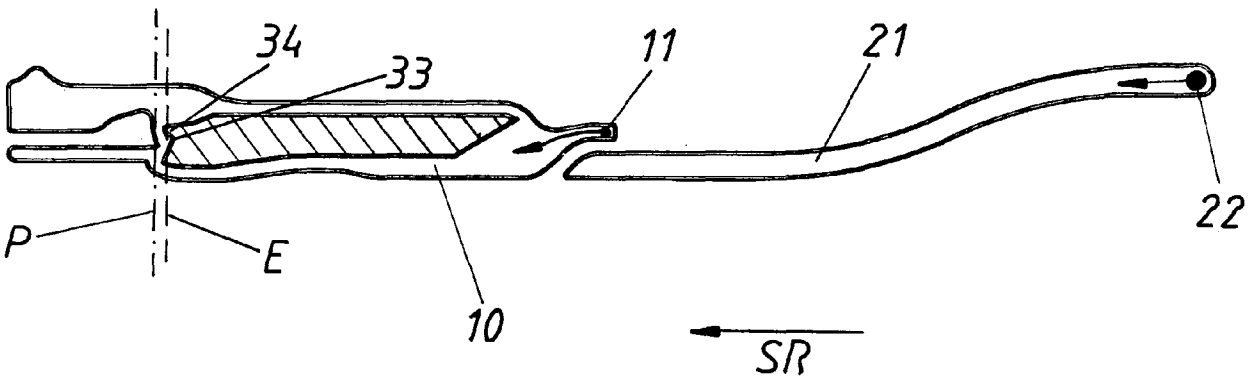
FIG. 15 shows a portion of the heart curve-shaped sliding guide path and the control cam sliding guide path in the housing.

FIG. 15 shows only portions of the two control cams, the heart curve projection 11 being diagrammatically shown at the beginning of the closing movement SR. That heart curve projection 11 moves along the lower region of the heart curve-shaped sliding guide path 10 in the direction of the closed end position E, wherein the heart curve projection 11 stops in the recessed region 33 in that end position E and thus the entire drawer 5 is held in place. By overpressing on the drawer 5 the heart curve projection 11 is moved in the direction of the position P behind the closed end position E, wherein after the drawer 5 is released by the operator the heart curve projection 11 is ejected along the upper region of the heart curve-shaped sliding guide path 10 by the oppositely acting elastic element 16 in the opening direction OR. The movement of the control cam projection 22 which by virtue of the cam configuration in the control cam sliding guide path 21 causes the pivotal movement of the locking element 4 takes place in corresponding relationship with the direction of movement of the heart curve projection 11.

Figure 16:
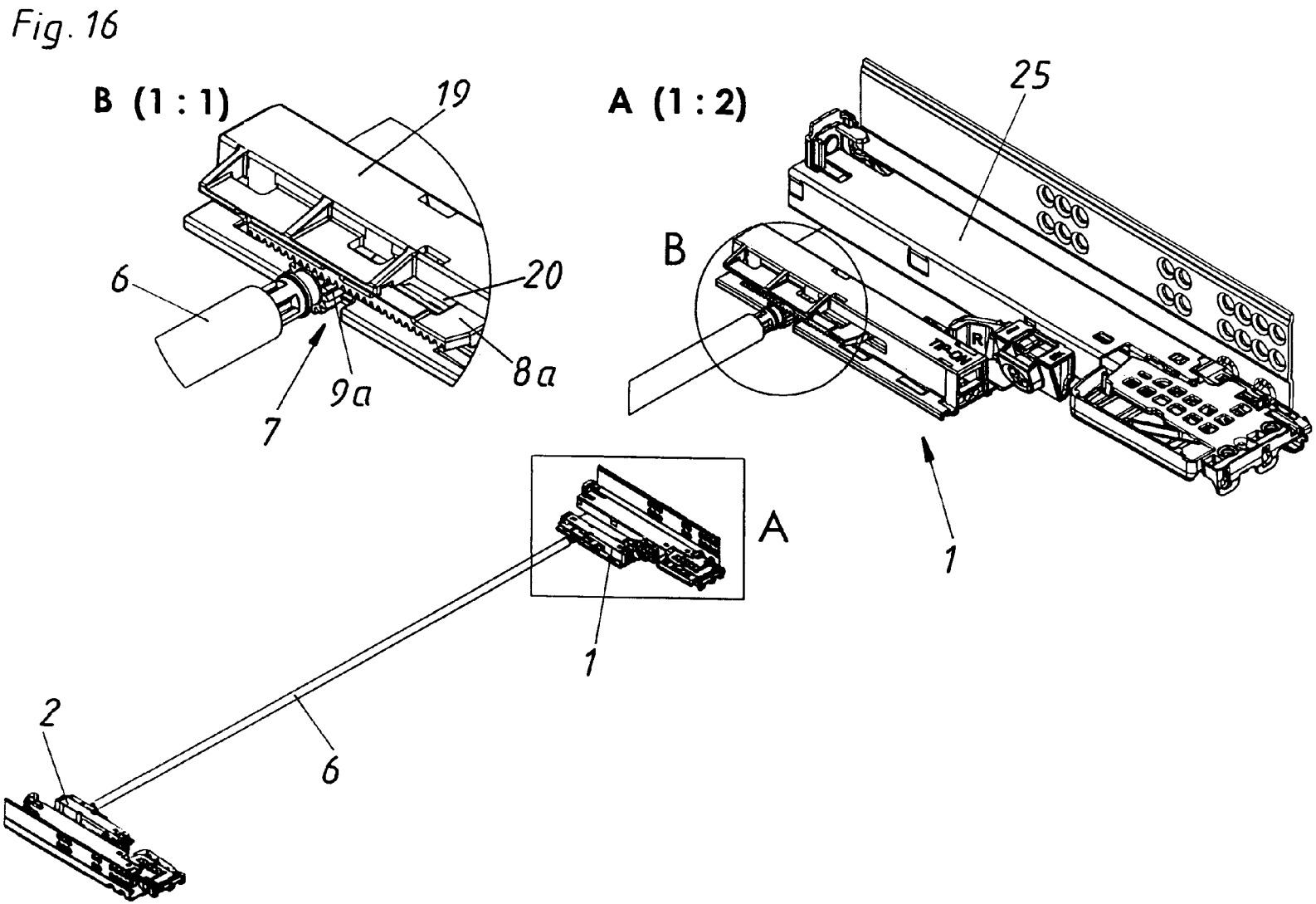
FIG. 16 shows the unlockable ejection device together with the synchronization rod and extension guide means.

FIG. 16 once again shows the ejection devices 1 and 2, together with synchronization rod 6, which can be mounted to the furniture body, wherein the Figure additionally shows in the right-hand region an extension guide means 25 which can be fixed to the side wall of the body. By way of example the spring-loaded ejector could also be arranged therein and would not have to form a part of the unlockable device per se. An automatic pull-in mechanism could also be provided herein.

Figure 17:
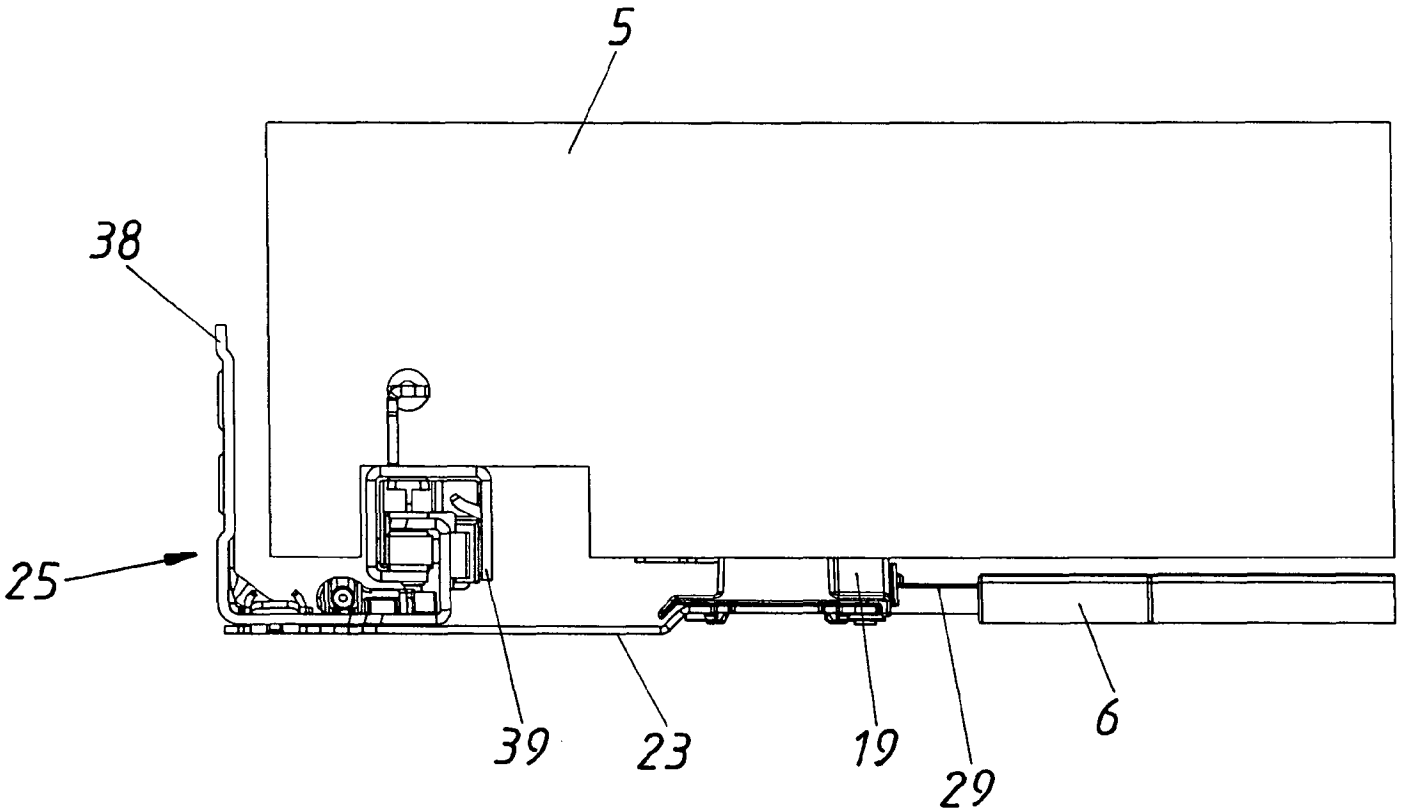
FIG. 17 shows a view from behind of a half of a drawer with an unlockable ejection device.

FIG. 17 shows a further embodiment of an ejection device 1 according to the invention for a movable furniture part 5 in a view from behind, showing only one half of the movable furniture part 5 and accordingly only one extension guide means 25 and ejection device 1. The movable furniture part 5 is movable with an extension guide means 25 including a body rail 38 and a drawer rail 39. This embodiment shows a partial extension assembly which is of lower installation height than a full extension assembly. To prevent a collision between the rear wall of the furniture body 3 and the synchronization rod 6 or to avoid subsequent manual operation on the movable furniture part 5 or the furniture body 3 the synchronization rod 6 is not of a round cross-section but of an oval cross-section. Likewise the splined shaft 29 is of oval cross-section. The ejection device 1 is arranged on the mounting plate 23. The transmission (not shown in greater detail here) with gear 9*a* and rack 8*a* is arranged at or in the housing 19. The splined shaft 29 which is of an oval cross-section is arranged on the gear 9*a* and engages into the synchronization rod 6 which in this case is also of an oval cross-section.

Figure 18:
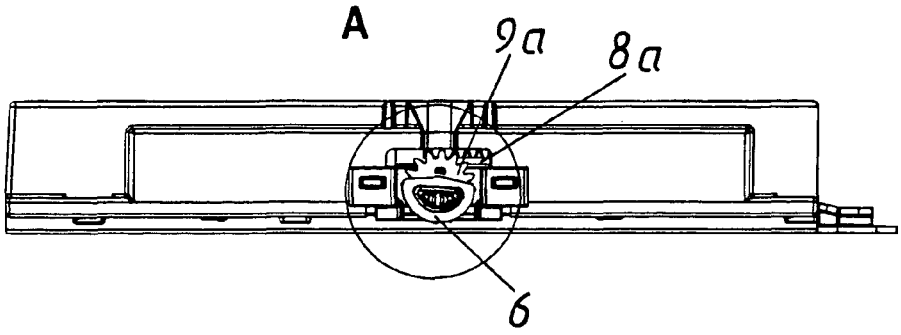
FIG. 18 shows a side view of a further embodiment of an unlockable ejection device.
Figure 19:
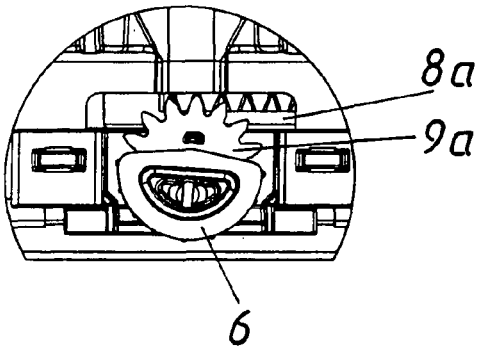
FIG. 19 shows a detail view of the portion marked with A in FIG. 18.

FIG. 18 shows a side view of the unlockable ejection device 1 of the embodiment of FIG. 17, with the housing being partially cut out. As can be seen from this Figure but in particular also from FIG. 19 showing a detail view of the portion marked by A in FIG. 18, the synchronization rod 6 but also the associated splined shaft 29 is of an oval cross-section which overall is of a lower height and is thus flatter than the round synchronization rod 6 of the above-indicated embodiment.

Figure 20:
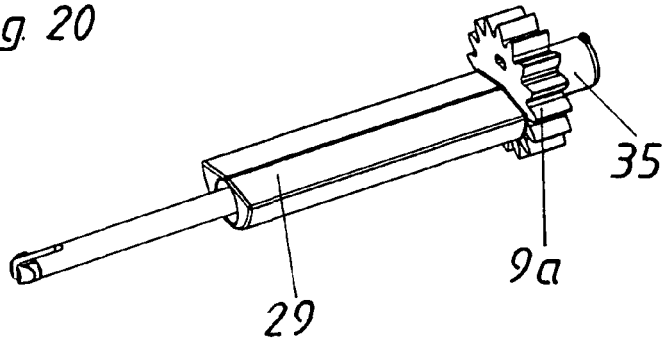
FIG. 20 shows a perspective view of a further embodiment of a splined shaft of the unlockable ejection device.

FIG. 20 shows a perspective view of this embodiment of the invention, the splined shaft 29 arranged on the gear 9 being of an oval cross-section. The synchronization rod 6 is in association also of an oval cross-section.

Figure 21:
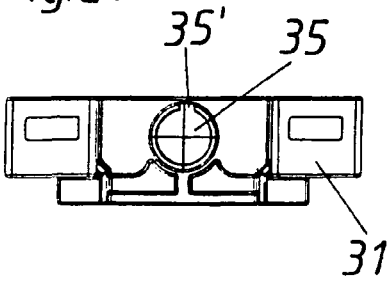
FIG. 21 shows a side view of a further embodiment of a holding sleeve for an unlockable ejection device.

The side view in FIG. 21 illustrates a further embodiment of the holding sleeve 31 which has an opening corresponding to the nose 35' of the rotary shaft 35 so that the rotary shaft 35 and therewith the synchronization rod 6 are correctly mounted. In this case correct mounting means that the flat location of the oval cross-section of the synchronization rod 6 or the splined shaft 29 is arranged upwardly, that is to say in the direction of the bottom of the drawer. In the case of a synchronization rod 6 of round cross-section the manner of mounting the rotary shaft 35 in the holding sleeve 31 is irrelevant.

Thus assembly of all parts without the use of a tool is possible by virtue of this invention. In addition the drawer is fixed but also ejected on both sides. There is no loss of space behind the drawer because the synchronization shaft is positioned beneath the drawer. The drawer and the body do not have to involve additional working thereon. Signal and force transmission is effected from the synchronization shaft by way of the pinion of the gear to the rack. Synchronization further prevents the panel being able to stand away at one side and the drawer can be reliably closed.

In general it should be pointed out that all the specified embodiments which do not relate to the synchronization rod are described both for an unlockable ejection device and also for an arrangement having two substantially mirror-image symmetrical unlockable ejection devices.

Locking and ejecting a movable furniture part (5) involves two unlockable ejection devices (1, 2) arranged on both sides of a furniture body (3), or on the movable furniture part (5), and spring-loaded ejectors (13) the unlockable ejection devices (1, 2) comprise a catch element (18) mounted on a linearly displaceable carriage (17), the catch element (18) engaging into a slotted guide path (10) having the shape of a heart curve and by which the movable furniture part can be held in a closed latching position (E) via a locking element (4). This latching position (E) can be released by overpressing the movable furniture part (5) towards the interior, wherein the linearly displaceable carriages (17) of the two unlockable ejector devices (1, 2) are motionally coupled via a rotatable synchronization rod.

The invention claimed is:

1. An arrangement for locking and ejecting a movable furniture part, comprising:

two unlockable ejection devices to be arranged at spaced positions on one of a furniture body and a movable furniture part;

spring loaded ejectors for ejecting the movable furniture part from the furniture body;

wherein each of said two unlockable ejection devices comprises a linearly displaceable carriage, a latching element mounted on said linearly displaceable carriage, a curved sliding guide path into which said latching element engages, and a locking element, wherein said latching element, said curved sliding guide path and said locking element are arranged with respect to each other so as to be able to, when provided on the one of the furniture body and the movable furniture part, hold the movable furniture part in a closed latching position with said locking element as well as release the movable furniture part from the closed latching position in response to pressing the movable furniture part inwardly into the furniture body from the closed latching position; and a rotatable synchronization rod that couples said linearly displaceable carriage of both of said two unlockable ejection devices for movement with each other.

2. The arrangement of claim 1, wherein each said carriage is connected to said synchronization rod by a transmission that converts linear carriage movement into rotary movement of said synchronization rod.

3. The arrangement of claim 2, wherein said transmission comprises an element mounted for displacement together with said carriage and a rotary element for force transmission to said synchronization rod.

4. The arrangement of claim 3, wherein said element mounted for displacement is a rack and said rotary element is a gear meshing with said rack.

5. The arrangement of claim 4, wherein said locking element, said rack, one of said ejectors and said latching element are coupled to said carriage for movement therewith.

6. The arrangement of claim 4, wherein said carriage, one of said ejectors and said latching element are in one piece.

7. The arrangement of claim 4, wherein said transmission comprises a said gear on each end of said synchronization rod meshing with a respective said rack of said unlockable ejection devices.

8. The arrangement of claim 7, wherein each said gear is non-rotatably connected to said synchronization rod by a respective splined shaft.

9. The arrangement of claim 7, wherein said synchronization rod comprises at least one elastic element therein that acts on at least one said gear in a longitudinal direction of said synchronization rod.

10. The arrangement of claim 1, wherein said locking element is mounted on said carriage such that when in the closed latching position, said locking element can hold the movable furniture part by holding a holding element on the movable furniture part.

11. The arrangement of claim 10, wherein said ejectors form respective parts of said two unlockable ejection devices and are arranged so that the movable furniture part can be opened or ejected by each said ejector engaging a respective holder on the movable furniture part.

12. The arrangement of claim 1, wherein said latching element comprises a projection that engages said curved sliding guide path.

13. The arrangement of claim 1, wherein each of said ejection devices comprises an elastic element that is arranged to act on said linearly displaceable carriage.

14. The arrangement of claim 13, wherein said elastic element comprises a spring having a spring force that acts on said carriage in an ejection direction and is arranged with respect to said carriage so that when said unlockable ejection devices are mounted on one of the furniture body and the movable furniture part: (1) movement of the movable furniture part in a closing direction causes said spring to increase in stored spring force, and (2) said ejector linearly moves a holding element of the movable furniture part in an opening direction in response to movement of said carriage by the spring force of said spring.

15. The arrangement of claim 1, wherein said locking element is pivotably mounted to said carriage at a pivot point and said latching element is pivotably mounted to said carriage at a pivot point.

16. The arrangement of claim 1, wherein each of said ejection devices further comprises a housing, said carriage arranged so as to be linearly displaceable in said housing.

17. The arrangement of claim 16, wherein one of said ejectors and said locking element project from said housing through a housing opening.

18. The arrangement of claim 16, wherein said curved sliding guide path is provided in said housing and said latching element has a projection that engages said curved sliding guide path.

19. The arrangement of claim 16, wherein said housing has a control cam sliding guide path therein which is engaged by a control cam projection that is arranged on said locking element.

20. The arrangement of claim 16, wherein each of said unlockable ejection devices further comprises a mounting plate onto which said housing can be fitted.

21. The arrangement of claim 20, wherein each of said unlockable ejection devices is structured so that: (1) each of said unlockable ejection devices can be fitted, using a respective said mounting plate, but without use of a tool, to spaced sides or surfaces of the furniture body and (2) each of said unlockable ejection devices can be subsequently connected by having said synchronization rod inserted therein.

22. The arrangement of claim 1, wherein said synchronization rod comprises two elastic elements that act on respective gears non-rotationally provided at ends of said synchronization rod.

23. An article of furniture comprising a furniture body, a movable furniture part movable relative to said furniture body and the arrangement of claim 1 mounted on one of said furniture body and said movable furniture part.

* * * * *